US007073413B2

(12) United States Patent
Duffy et al.

(10) Patent No.: US 7,073,413 B2
(45) Date of Patent: Jul. 11, 2006

(54) FOLD-AWAY WRENCH SET

(75) Inventors: Seamus Duffy, Lanseborough (IE); Nigel Buchanan, Fife (GB)

(73) Assignee: Smart Tools Ltd (GB)

( * ) Notice: Subject to any disclaimer, the term of this patent is extended or adjusted under 35 U.S.C. 154(b) by 23 days.

(21) Appl. No.: 10/493,465

(22) PCT Filed: Oct. 28, 2002

(86) PCT No.: PCT/GB02/04890

§ 371 (c)(1),
(2), (4) Date: Sep. 9, 2004

(87) PCT Pub. No.: WO03/035327

PCT Pub. Date: May 1, 2003

(65) Prior Publication Data

US 2006/0081095 A1 Apr. 20, 2006

(30) Foreign Application Priority Data

Oct. 26, 2001 (IE) ..... 2201/0943

(51) Int. Cl.
*B25B 13/04* (2006.01)

(52) U.S. Cl. ..... 81/124.5; 81/64; 81/177.6

(58) Field of Classification Search ..... 81/124.2, 81/124.5, 176.2, 177.6, 58.5, 64, 70, 486, 81/490

See application file for complete search history.

(56) References Cited

U.S. PATENT DOCUMENTS

| | | | | |
|---|---|---|---|---|
| 1,186,807 | A * | 6/1916 | Litomy | 7/168 |
| 1,402,373 | A * | 1/1922 | Palmer | 81/125.1 |
| 2,824,476 | A * | 2/1958 | Wilson | 81/58 |
| 4,967,612 | A * | 11/1990 | Sparling | 81/64 |
| 5,557,992 | A | 9/1996 | Macor | |
| 5,983,759 | A | 11/1999 | Turner | |
| 6,079,301 | A * | 6/2000 | Scolo | 81/177.6 |
| 6,978,701 | B1 * | 12/2005 | Buchanan | 81/98 |

FOREIGN PATENT DOCUMENTS

| | | | |
|---|---|---|---|
| GB | 235434 | A | 6/1925 |
| GB | 1603875 | A | 9/1971 |
| WO | WO-0058057 | A | 10/2000 |

OTHER PUBLICATIONS

International Search Report No. PCT/GB02/04890, dated Feb. 14, 2003.

* cited by examiner

*Primary Examiner*—David B. Thomas
(74) *Attorney, Agent, or Firm*—Connolly Bove Lodge & Hutz, LLP

(57) ABSTRACT

There is disclosed a fold-away wrench having a wrench head (9) pivotally mounted on a handle (2). The wrench head (4) is an open flexible ring socket (3*a*) locatable over a fastener such as a nut, bolt or screw to move it. Pins (17) are provided for engagement with the wrench head (4) to close the wrench head over a fastener to be moved. Preferably, the wrench head (4) is pivotable on an axis pin (10) at one end of the socket ring while at the other end of the socket ring is a fulcrum pin (17) for closing the socket over the fastener.

22 Claims, 13 Drawing Sheets

FIG 4a
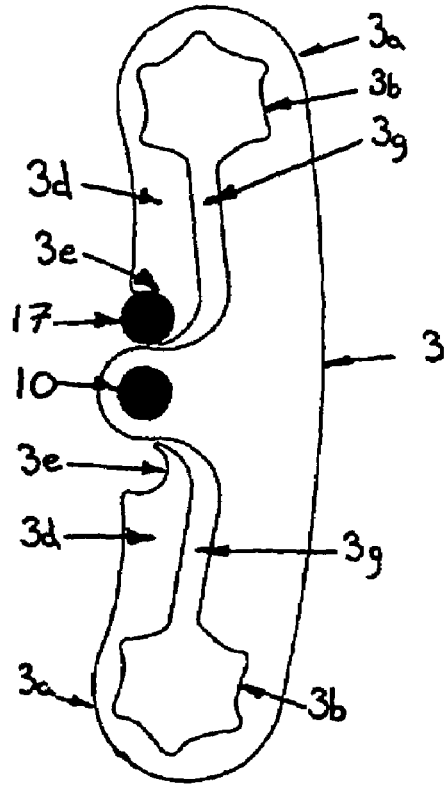
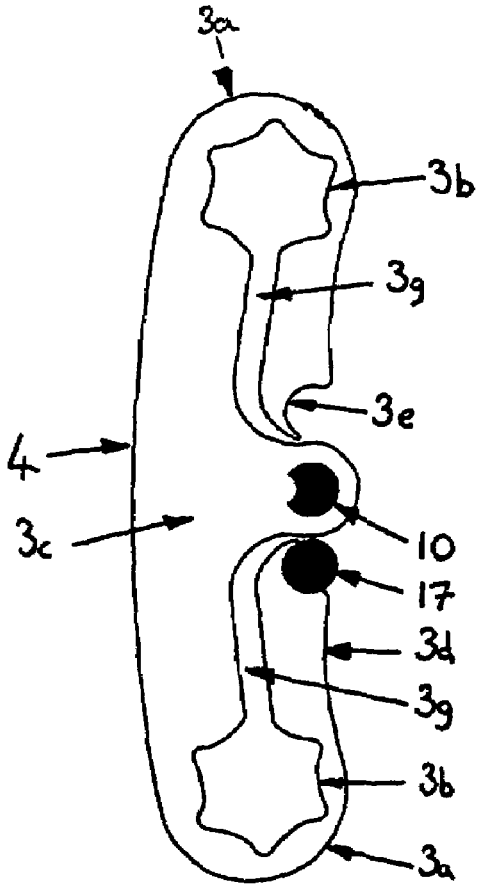
FIG 4b 3
3a
3b
3c
3d
3g
4
7
10
15
16
17

FOLD-AWAY WRENCH SET

FIELD OF INVENTION

This invention relates to a fold-away wrench or spanner. Wrenches or spanners as they are known in Great Britain are used for the purpose of tightening or slackening nuts, bolts or screws (hereinafter referred to as a fastener).

BACKGROUND TO THE INVENTION

The head portion of a ring wrench usually has an inner shape and size complementary to that of a typically hexagonal or square fastener head. The head of such a wrench has an inner surface which surrounds the fastener head with only a small amount of play between the inner surface of the wrench and the fastener head. As torque is applied to the wrench the torque is transmitted to the fastener head to turn the fastener in the appropriate direction.

Ring type wrenches are preferably to open jaw type wrenches because the torque applied to the wrench is transmitted to the fastener via a much larger contact area and the ring head of the wrench if closed can transmit far greater torque without harmful distortion of the fastener head and less chance of the wrench slipping off the fastener. Ring wrenches are however made to fit complementary fastener head sizes. Even if the inner ring wrench head surface is appropriately shaped only a small variation in size is possible between fastener head and the inner ring wrench head surface. Accordingly, wrenches are normally supplied in sets, for example a set of wrenches capable of use on the most common fastener sizes of say 10–19 mm would consist of 10 different wrench head sizes as well as the near equivalent imperial or metric sizes would consist of a further 5 Whitworth or B.S.P. sizes and 8-Inch A/F sizes.

Good quality wrench sets are quite easy to obtain and in use individually selected ones of the sets are found as necessary and used with the appropriately sized head of a fastener. When a fastener of another size is used the first wrench is discarded and another appropriately sized wrench is used. When a number of the wrenches are being used there is a tendency for the user to mislay a wrench size thereby extending the time and hence cost of completing a particular work task.

It is an object of the present invention to substantially alleviate the above mentioned disadvantages.

SUMMARY OF THE PRESENT INVENTION

According to the present invention there is provided a fold-away wrench including a handle and a wrench head mounted on the handle for pivotal movement relative thereto, the wrench head comprising an open flexible ring socket for engaging a fastener to be moved and means being provided on the wrench for closing said open flexible ring socket about a fastener when the handle is turned in a predetermined direction, the wrench head being pivotable from a storage position within the handle to an operative position extending outwardly of the handle.

In one preferred embodiment in accordance with the present invention the open flexible ring socket is pivotally mounted on an axis pin on the handle on one open side of the socket and a fulcrum pin is engageable with the opposite open side of the flexible ring socket for closing the socket over a fastener. Preferably, the axis pin and the fulcrum pin are aligned along a line parallel to the longitudinal axis of the handle. The fulcrum pin is preferably the outermost pin relative to the centre of the handle and is conveniently movable with the axis pin longitudinally of the handle.

The wrench preferably comprises a slot in the handle along which the fulcrum pin and axis are slidable. The slot is conveniently of a constant width along its length. However, in an alternative embodiment the slot comprises a bulbous inner end relative to the length of the handle, of a diameter greater than the width of the slot. In the latter embodiment the slot preferably comprises two opposed concave recesses alignable with the axis pin when the fulcrum pin engages the outermost end of the slot remote from the bulbous end.

Preferably, the axis pin and fulcrum pin are each cylindrical and include regions of diametrically opposed planar surfaces. The cylindrical surfaces of the axis pin preferably correspond to the diameter of the bulbous end of the slot and opposed recesses so that the axis pin can rotate therein.

The diametrically opposed planar surfaces of the axis pin preferably are spaced by an amount corresponding to the width of planar side walls of the slot so that the axis pin is slidable in the slot with the planar surfaces of the pin aligned parallel to the planar side walls of the slot. Preferably, the opposed parallel planar surfaces of the axis pin extend the whole length of the axis pin.

The opposed parallel planar surfaces of the fulcrum pin may extend over a portion of the length of the fulcrum pin from each end thereof, an intermediate space between the two said planar surface portions comprising a cylindrical formation.

The wrench head may comprise two interconnected open flexible ring sockets together pivotable about the same axis pin. There may be two interconnected ring sockets, one located at each end, respectively, of the handle for movement relative thereto. Preferably, each pair of interconnected flexible ring sockets comprise sockets of different sizes.

Conveniently, each open flexible ring socket comprises an arm extending outwardly from an open end thereof for connection to the axis pin, and a freely movable arm extending from the other open end of the flexible ring and being engageable with the fulcrum pin for movement towards the first mentioned arm to close the socket around a fastener to be moved. Preferably, wherein the wrench head comprises a single open flexible ring socket mounted on a pivot for pivotal movement relative to the handle. The wrench may comprise a pair of single open flexible ring sockets, one socket located at each end, respectively, of the handle for pivotal movement relative to the handle.

Alternatively, the wrench may comprise a pair of single open flexible ring sockets mounted on either side of a central plate, one socket of each pair of sockets being located at each end, respectively, of the handle.

Therefore, there is provided an improved ring wrench whereas one wrench head is designed to enable torque to be conveniently applied to fit several sizes of fasteners. For example, one single wrench head can be made to fit 12, 13, 14 mm sizes ½, 9/16 inch A/F sizes and ¼ B.S.P. or equivalent Whitworth imperial sizes of fastener head. The wrench head preferably can be part of a set of wrenches conveniently presented in a foldaway or pocket sized package wherein the wrench holder or operating handle contains the required set or wrench heads. The wrench head is arranged to pivot around an axis on the handle until engaging a stop. If the wrench head is applied to an appropriate sized fastener and a force is applied in the appropriate direction, the wrench head will rotate around the axis pin incorporated in the handle until the free arm of the wrench head comes into contact with the stop/fulcrum pin also incorporated in the handle. As torque is applied to the handle and the wrench head a turning force is applied to the fastener. The greater the torque required to turn the fastener the greater the force acting on the free arm of the wrench head against the fulcrum pin. This force between the fulcrum pin and the free arm of the wrench head closes the gap between the free arm and the fixed arm of the wrench head closing the inner wrench head surface around the fastener and greatly increasing the grip on the fastener. The wrench head will continue to resiliently constrict around the fastener until either the fastener turns or the fastener size prevents the wrench head from constricting any further requiring use of another near sized wrench socket to be operated without damage to the fastener. Because the metal of the resilient ring of the wrench head is being pulled around the fastener head from the free end to the fixed end it is inherently stronger than known ring wrench heads. The fold-away wrench of the present invention is essentially a one directional device (operation in the opposite direction requires that the handle be rotated 180° about its longitudinal axis). The inner wrench head surface can be profiled to enable maximum leverage between the wrench head and fastener yet allowing a greater amount of fastener sizes to be accommodated. When a generally internal polygonal surface of a wrench head socket is operated, the turning effect is greatest at the point nearest the corners of the polygonal surface but only those in the direction in which the required rotation occurs. No torque whatsoever is transmitted through the opposite corners. Therefore, the inner wrench head surface needs only to act on the half of each flat of the polygonal surface which is in the direction of torque applied enabling the profile of the present inner wrench head surface to be shaped so that contact between fastener and inner wrench head surface is only made in the direction of the torque applied enabling greater diversity of sizes of fastener heads to be used with any one wrench head socket.

BRIEF DESCRIPTION OF THE DRAWINGS

Embodiments of the present invention will now be described by way of example with reference to the accompanying drawings, in which:

FIG. 4A is a side elevational view of a first wrench head used in the wrenches of FIGS. 1 to 3;

FIG. 4B is a side elevational view of a second wrench head used in the wrench of FIGS. 1 to 3;

DESCRIPTION OF PREFERRED EMBODIMENTS

Figure 1:
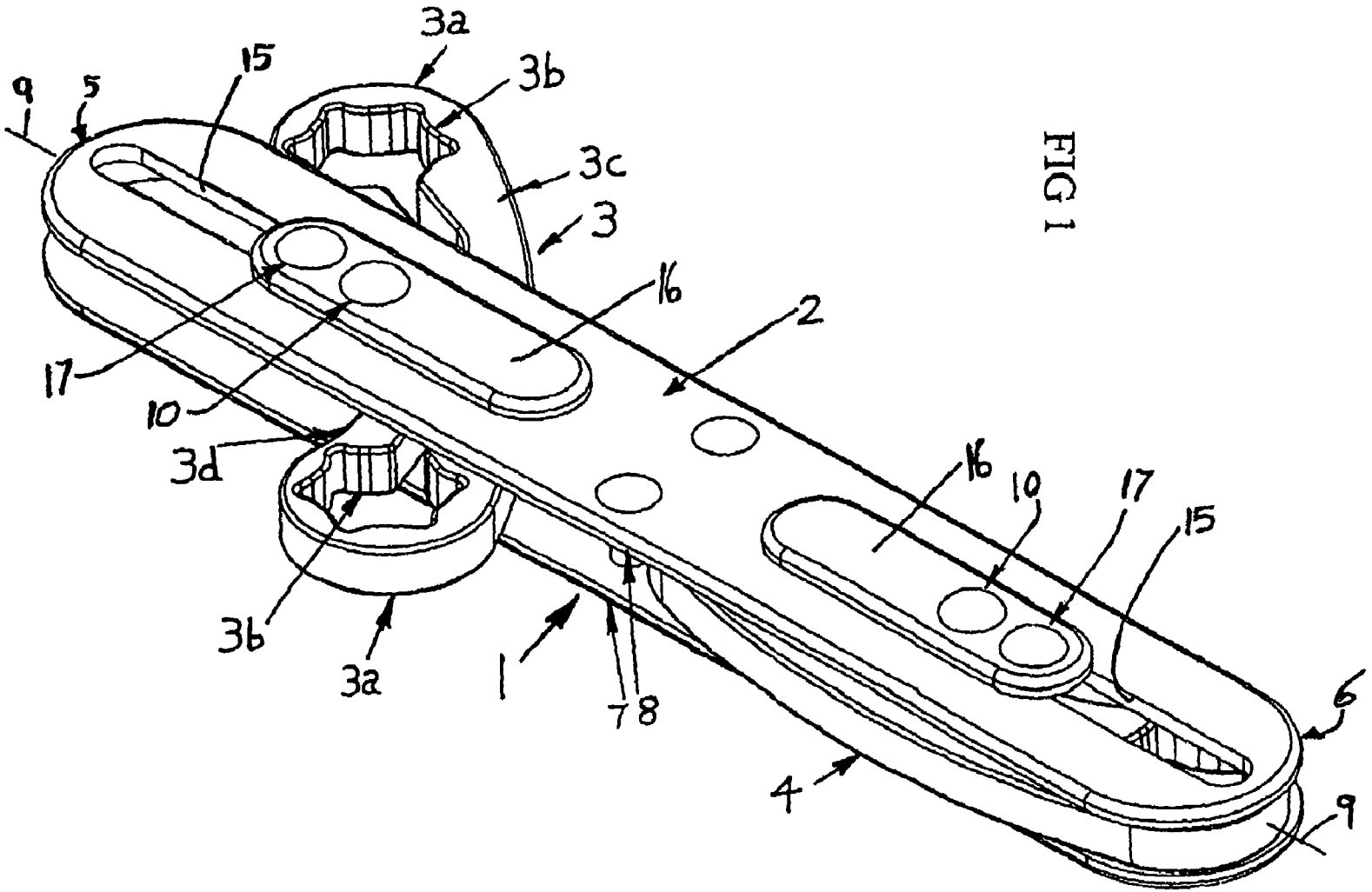
FIG. 1 is a perspective view of a fold-away wrench with a wrench head arranged to swivel out of a handle.

The embodiments described herewith will be described with reference to FIGS. 1 to 6 or FIGS. 7 to 10 or FIGS. 11(*a*), (*b*) and (*c*). Throughout the drawings like parts will be referred to by the same reference numerals.

FIG. 1 illustrates an elongate wrench (1) comprising a handle (2) supporting two pivotal wrench heads (3,4), one at each opposed end (5,6) of the handle (2).

The handle (2) comprises two overlying elongate parallel spaced plates (7,8) having an elongate axis (9). The wrench heads (3,4) are each mounted between the plates (7,8) for pivotal movement about a respective axis pin 10. An elongate slot (15) is located at each end of each plate (7,8) so that the slots in each plate overlie each other at respective ends of the plates. The axis pin (10) at each end projects through each pair of slots respectively, and is terminated in a slidable plate (16) on either side of the handle so that the wrench heads while pivotable are also each movable backwards and forwards along the longitudinal axis (9) of the handle.

A further pin, a fulcrum pin (17), is located adjacent the axis pin 10 and extends parallel to the axis pin (10) through a respective one of the pairs of slots (15) and is terminated in plates (16) on opposed sides of the handle (2) so as to be movable with the axis pin.

Each wrench head is provided with two flexible split ring sockets (3*a*), one at each of two opposed ends of the wrench head. A fixed bridge (3*c*) interconnects the two remote sockets of the wrench head on one side of the split in each socket. Each socket has an inner polygonal wrench head surface (3*b*). The sockets (3*a*) are each provided on the opposite side of the split with a resilient tongue (3*d*) having a concave recess (3*e*) at a free end thereof which in use engages the fulcrum pin (17) as will be hereinafter described. A gap (3*g*) extends from socket inner surface (3*b*) between the bridge (3*c*) and tongue (3*d*) and as will be described below is effective for closing the socket.

When the wrench is not in use, both wrench heads (3,4) will usually be stowed in the handle (2) in the manner shown for wrench head (4) in FIG. 1. Both wrench heads operate in the same manner and in this description the movement of wrench head (3) only will be described in more detail to illustrate the operation of the wrench from the closed position shown in FIG. 5*f* to the open position shown in FIG. 5*g*. Other wrench heads disclosed herein each operate in the same or similar manner.

Figure 2:
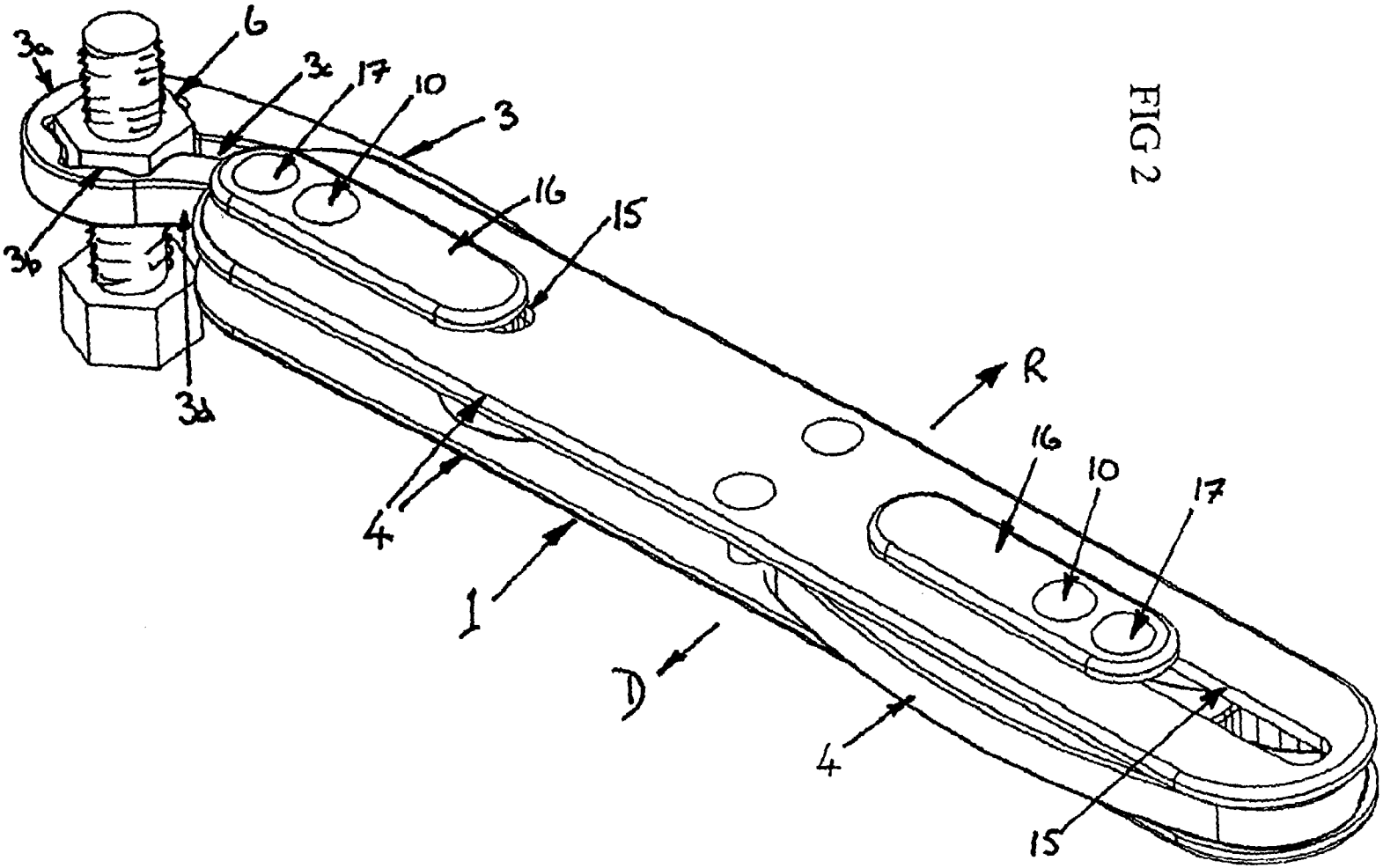
FIG. 2 is a perspective view of a fold-away wrench with the wrench head pivoted out of the handle and engaging a fastener.
Figure 3:
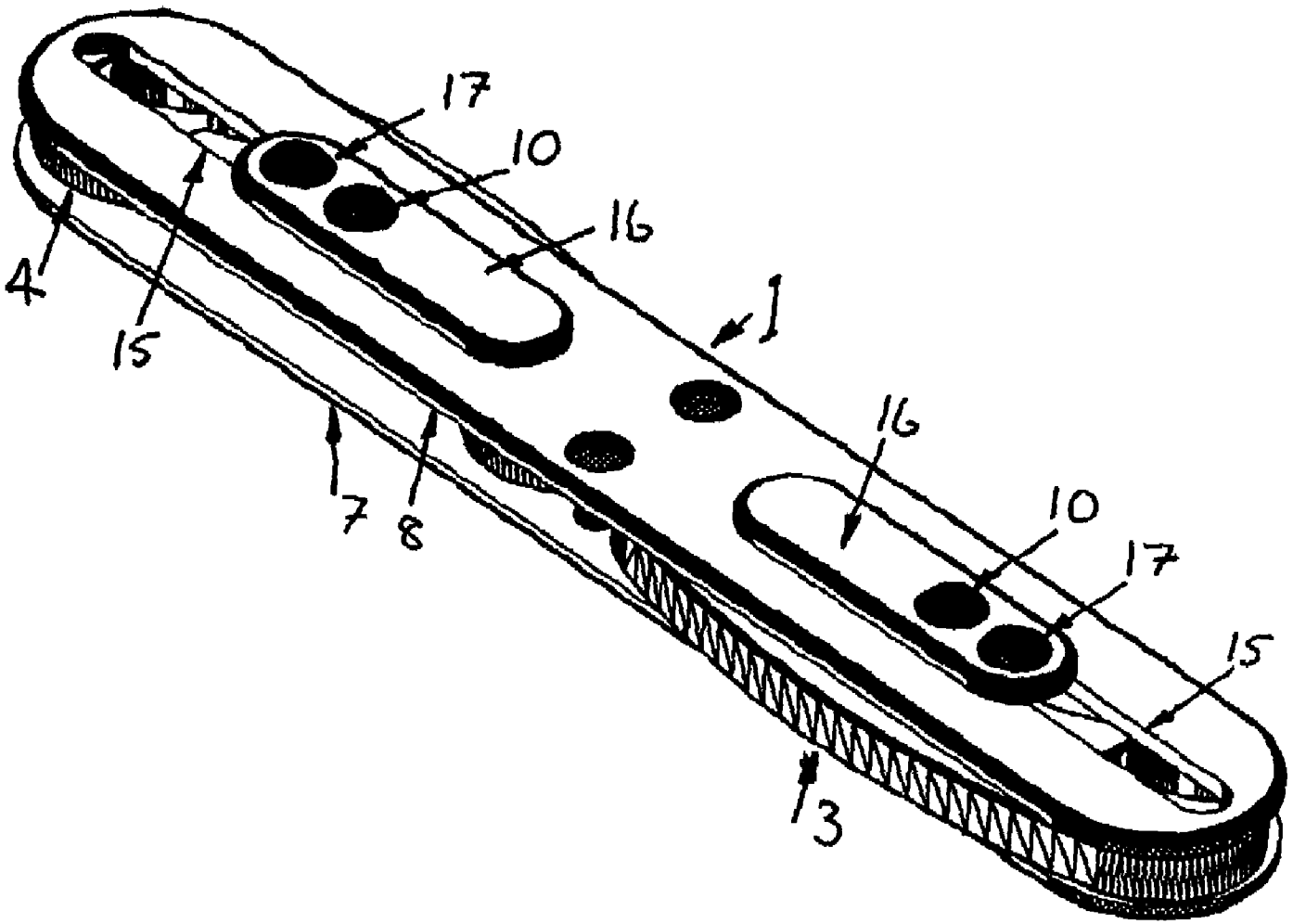
FIG. 3 is a perspective view of the fold-away wrench of FIGS. 1 and 2 with the wrench heads located for compactness within the handle.

To prepare the wrench for use, a selected wrench head, say the wrench head (3), is initially pushed from one side of the handle (2) or the other side until the position shown in FIG. 1 is obtained. The particular size of socket to be used is chosen, say the top socket (3*a*) in FIG. 1, and with the wrench head extending in a lateral direction relative to the handle, the plates (16) together with the axis pin (10) and fulcrum pin (17) are slid along the slot (15) from the inner most position shown in FIG. 1 to the outermost position as illustrated in FIG. 2. The wrench head (3) is then pivoted around axis pin (10) until it is in the position shown in FIG. 2 and as more clearly illustrated at the top of FIG. 5*g*.

This latter position of the wrench head (3) is more clearly illustrated in the enlarged views of FIGS. 4A and 4B. In the position shown in FIG. 4A the wrench head (3) has been pivoted about axis pin (10) and as it does so the convex recess (3*e*) at the head of the flexible tongue (3*d*) of a selected one of the split ring sockets engages the fulcrum pin (17). The wrench tool is then ready for use and in the condition shown in FIG. 2.

When torque is applied in the clockwise direction D to grip the fastener as shown in FIG. 2, a force couple is established between the fulcrum pin (17) and the axis pin (10) and this forces the tongue (3*d*) to move to close the gap (3*g*) between the tongue and bridge (3*c*), thereby to tighten the ring (3*a*) on the fastener. The more torque that is applied to the handle (2), the stronger will be the grip of the ring (3*a*) upon the fastener, and the less likely will it be that the wrench will slip.

As the force on the handle is removed to release the grip of the ring (3*a*) on the fastener, so the spring resilience in the ring (3*a*) re-opens the gap (3*g*) and the ring (3*a*) is able to be rotated about the fastener in an anti-clockwise direction for repositioning of the handle of the wrench prior to giving it a further clockwise turn so as further to move the fastener.

When the work on the fastener is completed, the respective split ring socket is removed from the fastener and the wrench head is pivoted about axis pin (10) so that it again extends transversely to the handle (2). The plates (16) and the pivot and fulcrum pins (10) and (17) and the wrench head are then pushed along slot (15) to its innermost position whereupon the wrench head (3) may be pivoted into the stored position shown in FIG. 3.

Figures 5A, 5B, 5C, 5D, 5E, 5F, 5G:
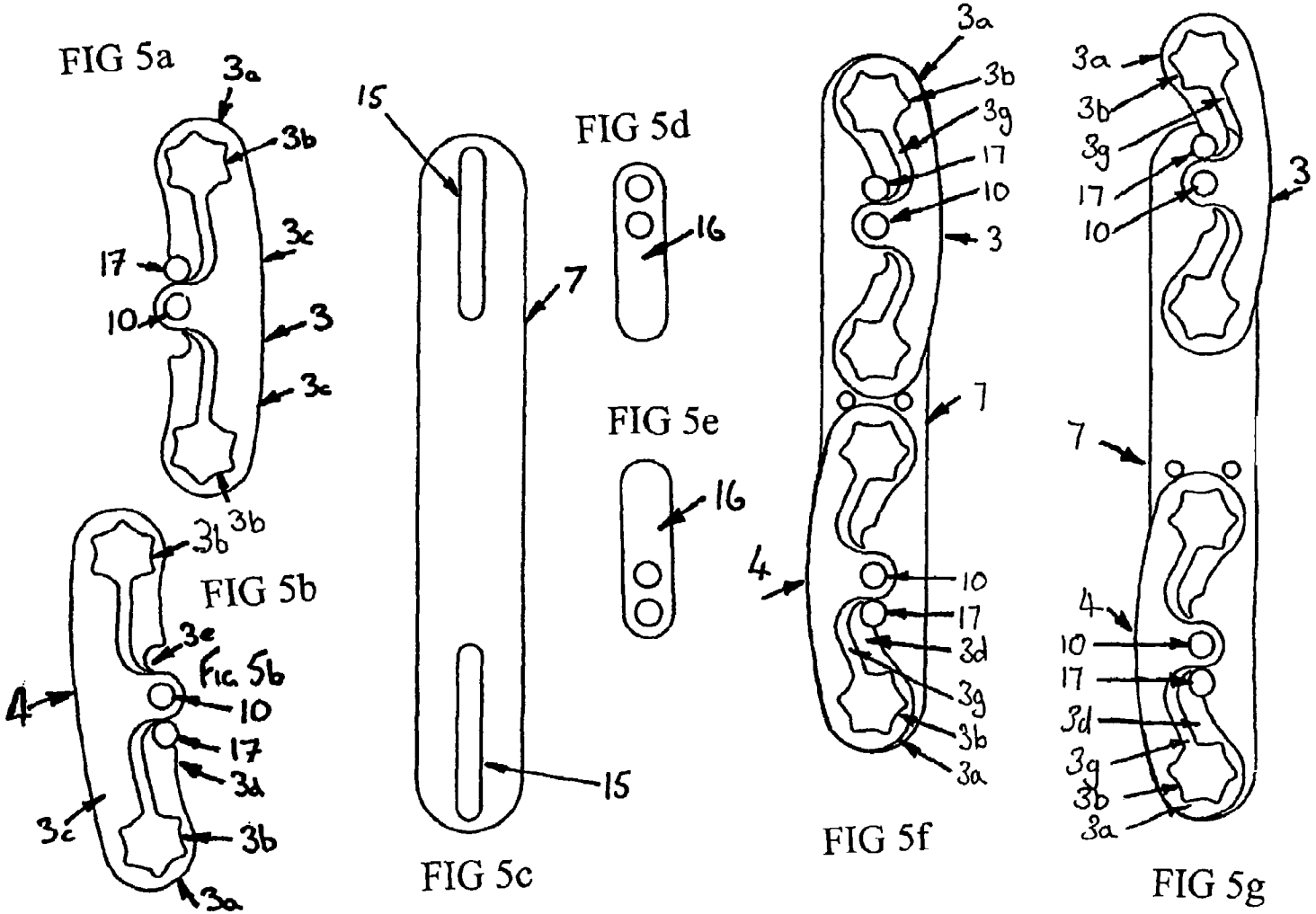
FIGS. 5(*a*) to (*g*) together show an expanded front elevational view illustrating the component parts of the wrench and the movement of the wrench heads relative to the handle.

Two fixed locking pins (20,21) are provided internally on at least one of the handle plates to act as detents to prevent the wrench heads (3,4) pivoting out from the handle as shown in FIG. 5*f*, unless firmly pushed out from that position. Other detent means, for example of a sprung ball type, could alternatively be provided.

Each socket can be used with a number of differently sized fasteners, the resilience of the socket rings and the width of the gaps (3*g*) providing this facility, and the four differently sized sockets provided on the wrench enable it to handle a wide range of different fastener sizes. A single wrench as above described can be capable of handling common fastener sizes of say 6 to 19 mm, the near equivalent imperial sizes or metric sizes, Whitworth or B.S.P. sizes and 8-inch A/F sizes.

Figure 6:
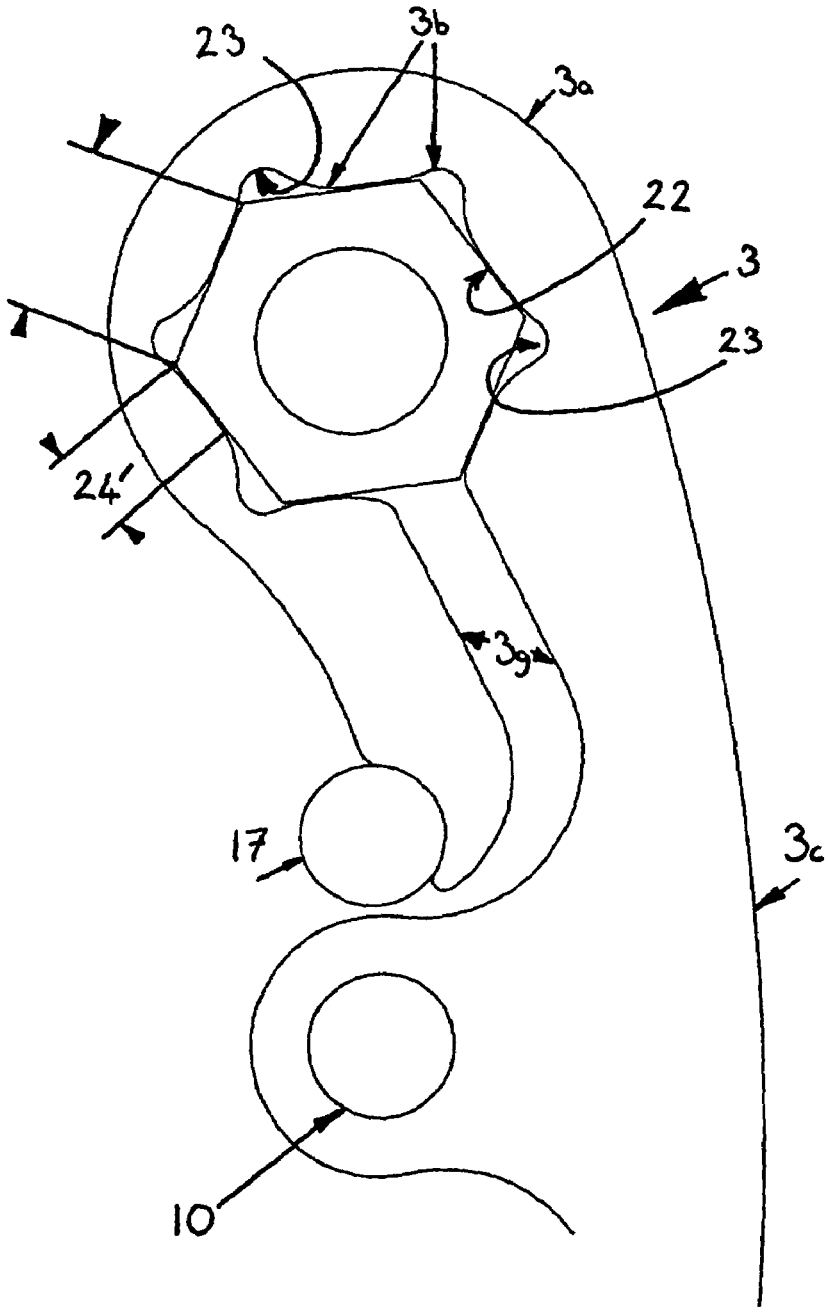
FIG. 6 is an enlarged front elevational view of part of the wrench head of FIG. 4A illustrating the transmission of torque between the wrench head and a fastener.
Figure 7:
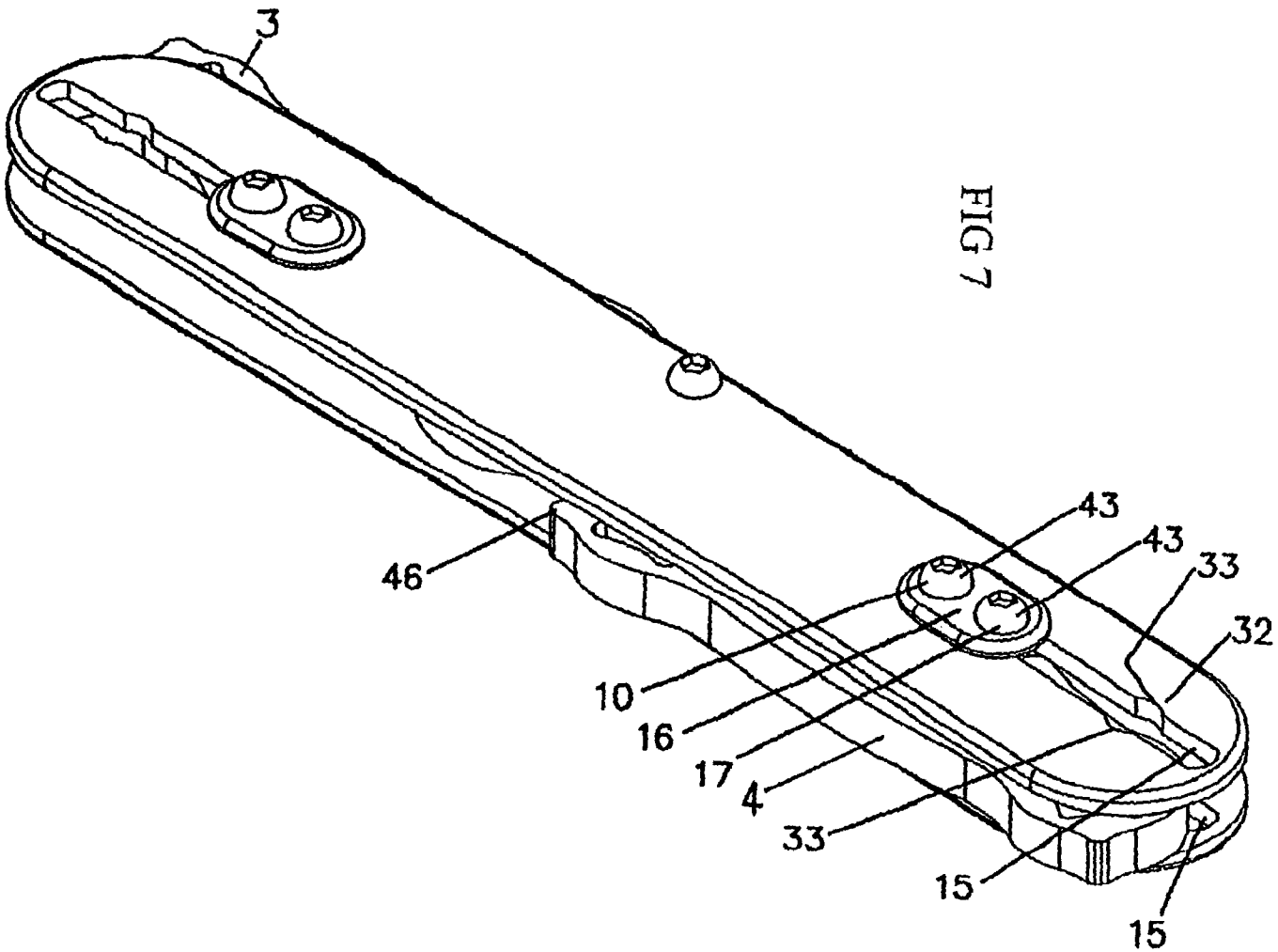
FIG. 7 is a perspective view similar to FIG. 3 illustrating an alternative embodiment of the wrench in accordance with the present invention.

As shown most clearly in FIG. 6, in a wrench in accordance with the invention, the inner surface (3*b*) of the wrench socket is preferably of a generally hexagonal shape but with convex bearing surfaces (22) which are concave at their ends (23), where they interconnect. This avoids excessive reliance upon the edges of a hexagonal fastener for developing turning force.

FIGS. 7 to 10 illustrate a different embodiment of the invention which is constructed and operates in a similar manner to the embodiments described above in regard to FIGS. 1 to 6. Accordingly the description which follows refers only to those parts of the wrench which are not disclosed in the embodiments described above.

The substantive difference between the wrench described above and the wrench of FIGS. 7 to 10 lies in the construction of the slots (15), and of the axis and fulcrum pins (10,17).

Each slot (15) in the embodiment of FIGS. 7 to 10 has, at its innermost end (30) with respect to the handle (2), a bulbous end (31) having an increased width relative to the lateral width of the elongate slot (15). A second region (32) of increased width of the slot (15) is provided spaced from the bulbous end (31), approximately three quarters of the way along the length of the slot (15) from the bulbous end (31) toward the outermost end of the slot. The increased width of the slot (15) at the second region (32) is provided by opposed concave recesses (33) in slot walls (34).

Figures 8A, 8B, 8C, 8D, 8E, 8F, 8G, 8H, 8I, 8J, 8K:
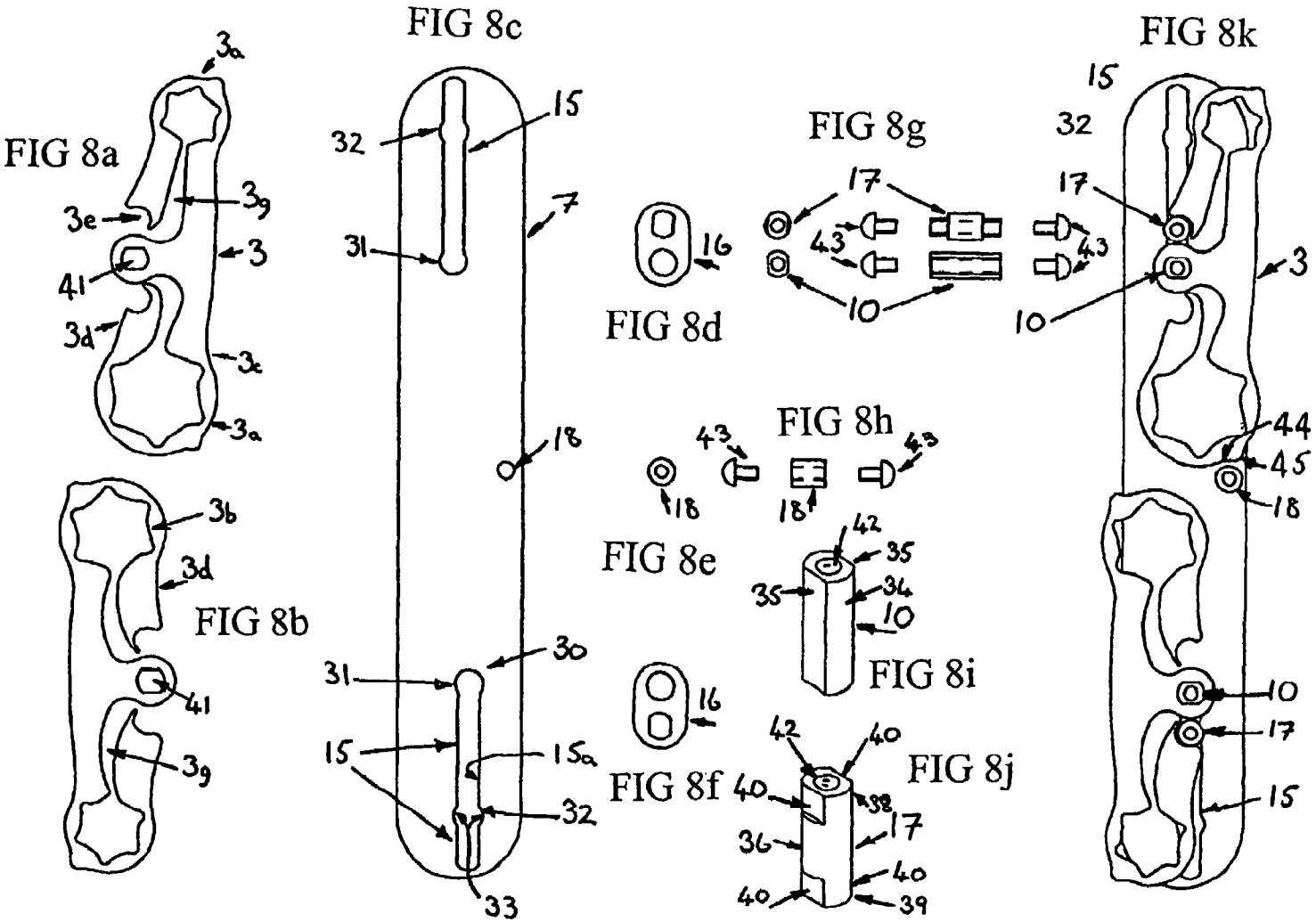
FIGS. 8(*a*) to (*k*) together show an expanded front elevational view of the wrench of FIG. 7 illustrating individual component parts individually and assembled together.
Figures 9A, 9B, 9C:
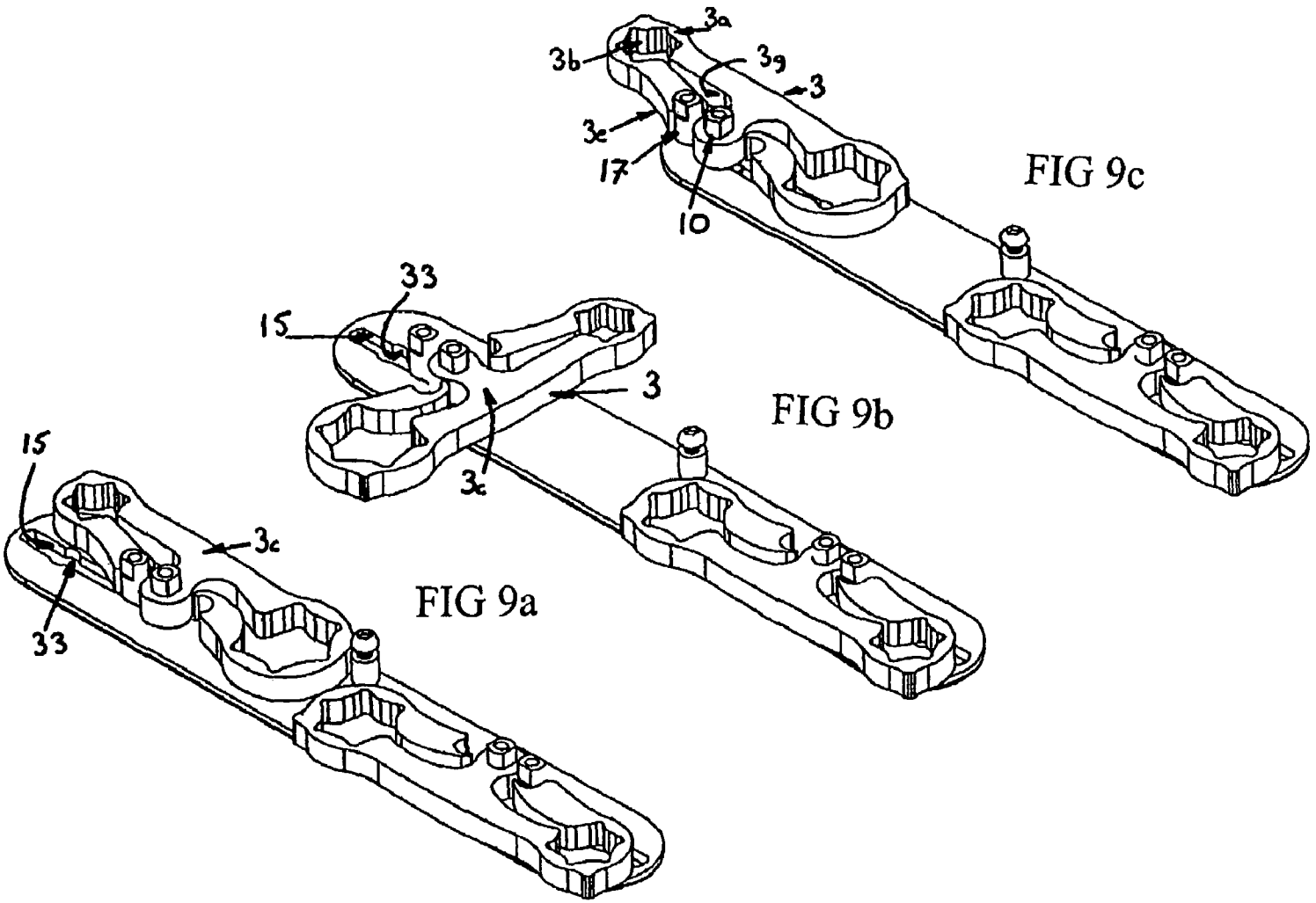
FIGS. 9(*a*), (*b*) and (*c*) are each perspective views of the wrench of FIGS. 7 and 8 each illustrating a different operational position of one wrench head.

The various views of FIG. 8 in particular show a view of the wrench exploded into its individual parts. The axis pin (10) and fulcrum pin (17) are shown in detail at FIGS. 8(*i*) and (8*j*). The axis pin (10) is in essence a cylindrical pin having a cylindrical surface (34) of a diameter corresponding to the diameter of the bulbous end (31) and the recessed area (32) which are of the same diametric width. The axis pin is also provided with diametrically opposed flat planar surfaces (35) which extend the whole of the axial length of the pin. The width between the diametrically opposed surfaces (35) corresponds substantially to the width of the slot (15) between opposed planar wall surface (34) thereof.

The fulcrum pin (17) is also a cylindrical pin of the same length and diameter as the axis pin (10), and has an external cylindrical surface (36). A central portion (37) of the pin (17) retains its cylindrical form. Each end (38,39) of the pin (17) has two diametrically opposed planar surfaces (40) spaced by a distance substantially corresponding to the width of the slot (15) between opposed planar wall surfaces (34) of the slot.

Therefore, the cylindrical surfaces (34,36) of the axis and fulcrum pins (10,17), respectively, serve in the wrench of FIG. 10 to allow the wrench heads (3,4) to rotate with the axis pin (10) about its rotational axis, and the fulcrum pin provides a curved central portion (37) for engagement by the concave recess (3*e*) of each tongue (3*d*) of the wrench head (3,4) respectively.

Each wrench head has an aperture (41) which has a cross-sectional shape corresponding to the cross-sectional shape of the axis pin (10) in FIG. 8. Therefore, the wrench head and its axis pin (10) are interlocked one relative to the other in the assembled wrench, and can only rotate together when located at the bulbous end (31) or the recessed region (32) of the slot (15).

Figures 10A, 10B, 10C:
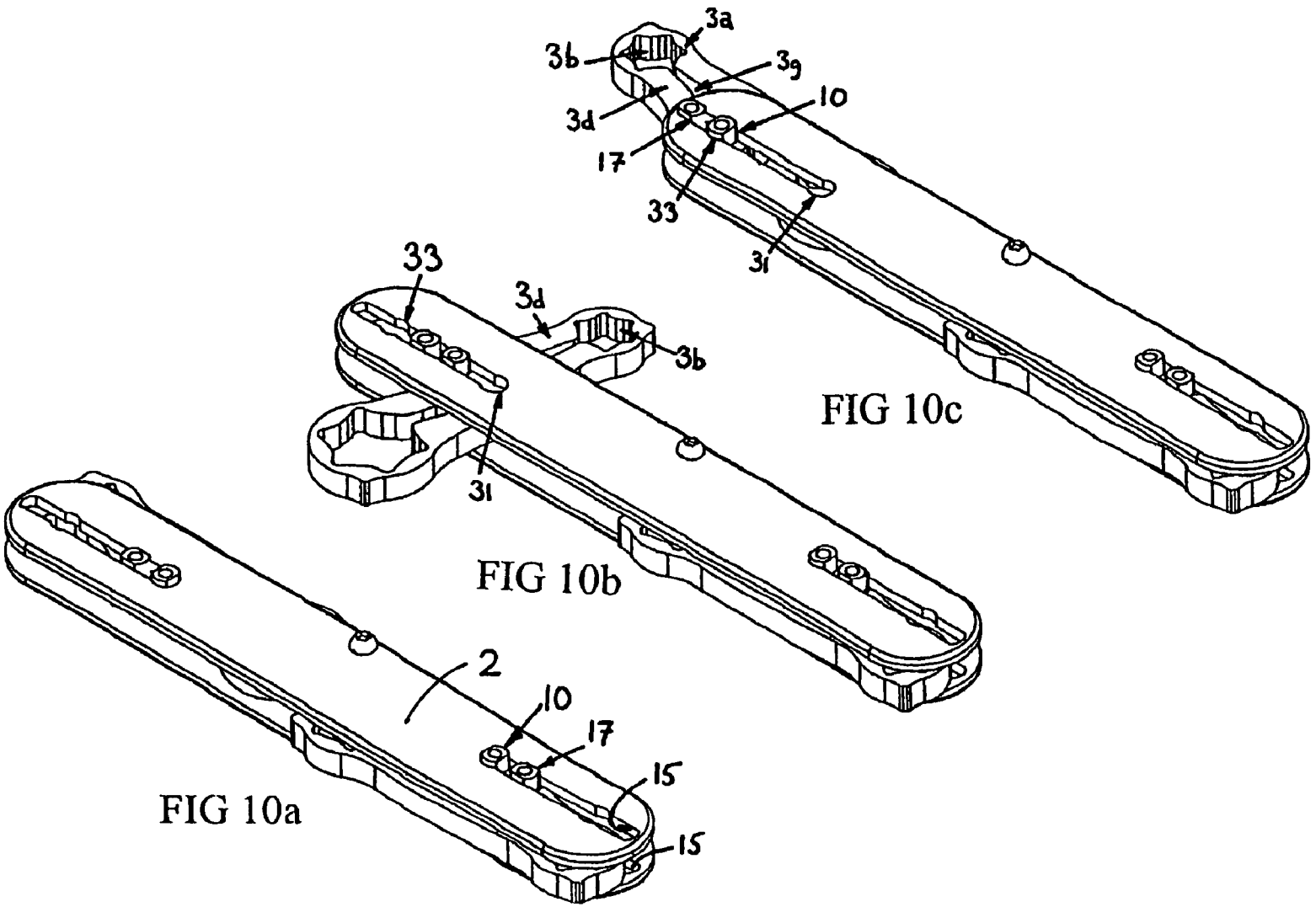
FIGS. 10(*a*), (*b*) and (*c*) are each perspective views corresponding to FIGS. 9(*a*), (*b*) and (*c*), respectively, illustrating the manner in which the wrench heads slide and pivot in grooves in side plates constituting the handle of the wrench.

As shown in FIG. 10*a*, when the wrench is not in use and the wrench heads (3,4) are located within the handle (2), the axis pin (10) locates at the bulbous end (31) and its opposed planar surfaces (35) lie transverse to the slot (15) thereby preventing movement of the axis pin along the slot (15). However, in this location the wrench head can be rotated so that the opposed planar surfaces (35) align with the slot (15) and allow the wrench head to be slid lengthwise of the slot (15), as shown in FIG. 10*b*. The wrench head (3,4) cannot be rotated in this position within the slot (15).

Once the wrench head is slid as far outwardly as the slot will allow and with fulcrum pin (17) against the outer end of the slot (15), the axis pin (10) is located between the recesses (33). The wrench head (3,4) and axis pin (10) are then rotatable until the wrench head is located in the position shown in FIGS. 9*c* and 10*c*. As is more clearly shown in FIG. 9*c*, the recess (3*e*) of the tongue of the wrench head engages the central portion (37) of the fulcrum pin (17). The wrench otherwise operates as described above with reference to the embodiment of FIGS. 1 to 6.

Each of the axis pin (10) and fulcrum pin (17) has a central elongate threaded aperture (42) (FIG. 8(*g*), 8(*i*) and 8(*j*)) in which screws (43) are located at either end of the pins and secured to slidable plates (16) in position on the external surfaces of the handle (2). A detent pin (18) also having a central elongate threaded aperture therethrough for receiving further screws (43) therein serves to act as a detent for preventing undue movement of the wrench heads in the stored position within the handle (FIG. 7), and to hold the sides of the handle (2) in place. The detent pin (18) is located to cooperate with a small recess (44) defined by a protrusion (45) on each flexible ring socket and the external surface of the flexible ring (3*a*) to prevent rotation of the wrench head (3) in the storage position. When it is necessary to rotate the wrench head, the head is released by applying a small amount of pressure to force the protrusion (45) past the detent pin. The detent pin will also just be engaged by protrusion (46) when wrench head (4) is rotated clockwise in FIG. 7. A small additional pressure moves the protrusion (46) past detent (18) so that the wrench head (4) can be rotated to a position in which the planar surfaces of its axis pin (10) are aligned with the slot (15) as described for wrench head (3).

In other embodiments which have similarities in construction and operation to the previously described embodiments, only the differences are described below. Otherwise, the wrench operates in the same manner as described for the embodiments of FIGS. 1 to 6 and 7 to 10.

Figure 11A:
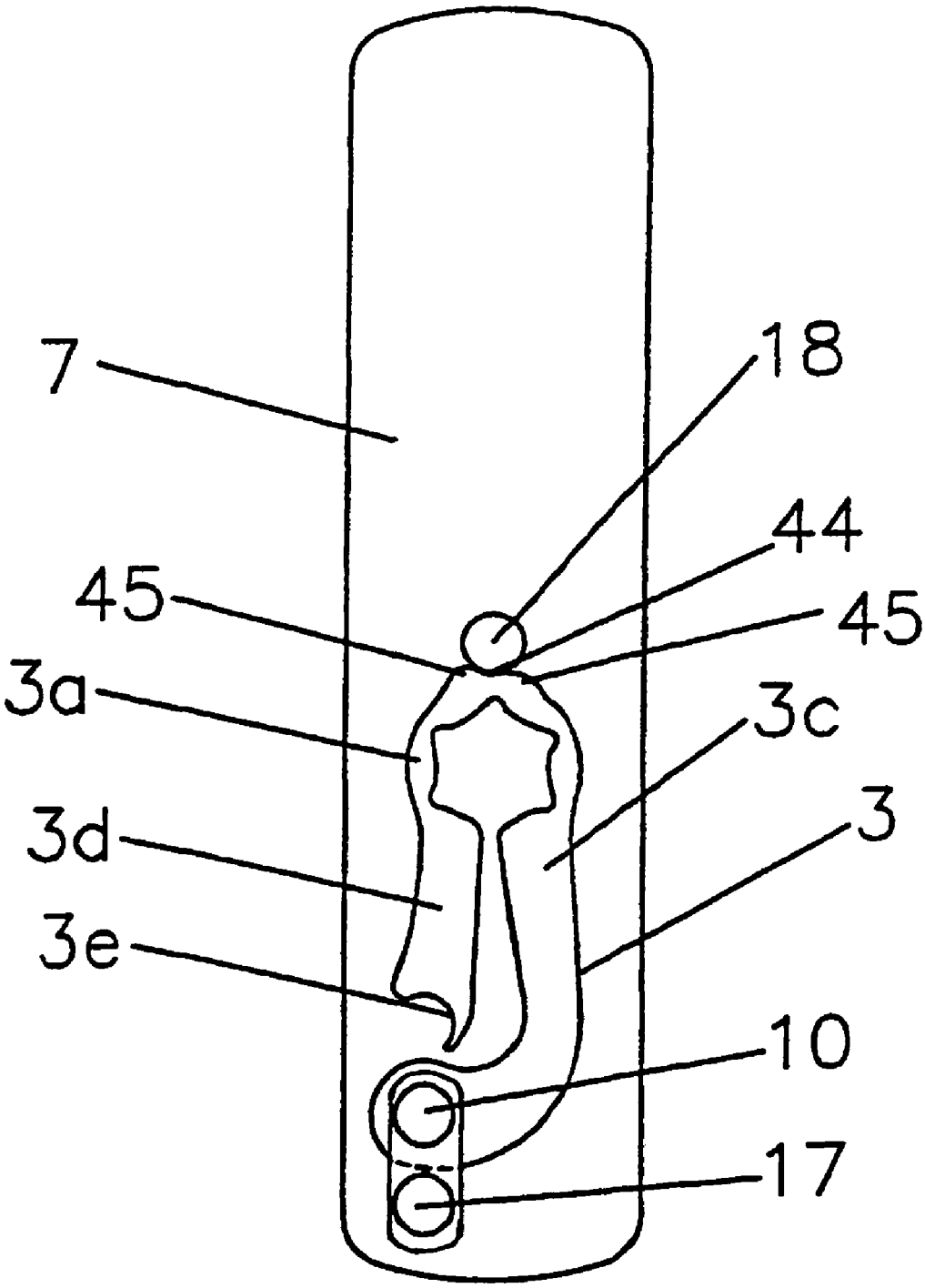
FIGS. 11(*a*), (*b*) and (*c*) are each front elevational views illustrating different embodiments of a fold-away wrench of the present invention

FIG. 11*a* discloses a wrench having a central elongate plate (50) on which a pivotal wrench head (51) is mounted at one end thereof.

Only one wrench head is shown in FIG. 11*a* for illustrative purposes. However, modified forms of this embodiment are shown in FIGS. 11(*b*) and 11(*c*) and have more than one wrench head.

As shown in FIG. 11*a* the wrench head (3) is mounted for pivotal movement about an axis pin (10) which is fixed in position relative to the central plate (7). A fulcrum pin (17) is similarly mounted in a fixed position on the plate (7) adjacent the axis pin (10). A detent pin (18) is located centrally of the plate (7) to hold the socket/flexible ring (3*a*) in a position overlying the plate by the pin engaging a recess (44) defined between protrusion (45) and the outer surface of the flexible ring (3*a*).

Pressure is applied to wrench head (3) to pivot the head away from the detent pin (18) outwardly from the central plate (7) until recess (3*e*) at the end of flexible tongue (3*d*) engages fulcrum pin (17). The recess (3*e*) is of a size which requires a slight pressure to be applied to the socket until the recess (3*e*) clicks over the fulcrum pin temporarily locking the socket in its operative position extending generally outwardly of the central plate in a direction substantially parallel to the longitudinal axis of the central plate (7). The wrench (1) then operates in the same manner as described above with particular reference to FIGS. 1 to 6, to tighten or slacken a fastener.

Figure 11B:
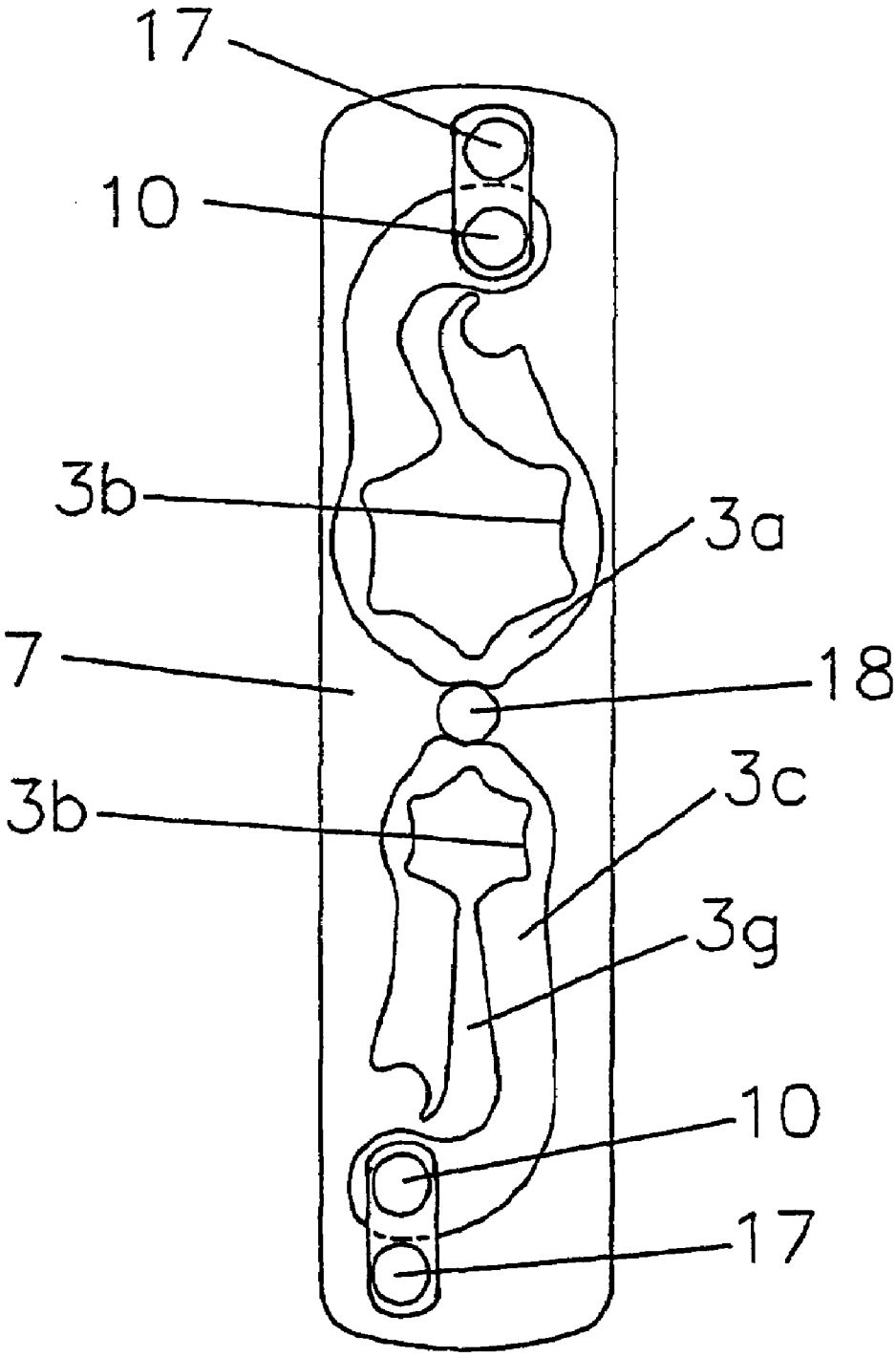
Figure 11C:
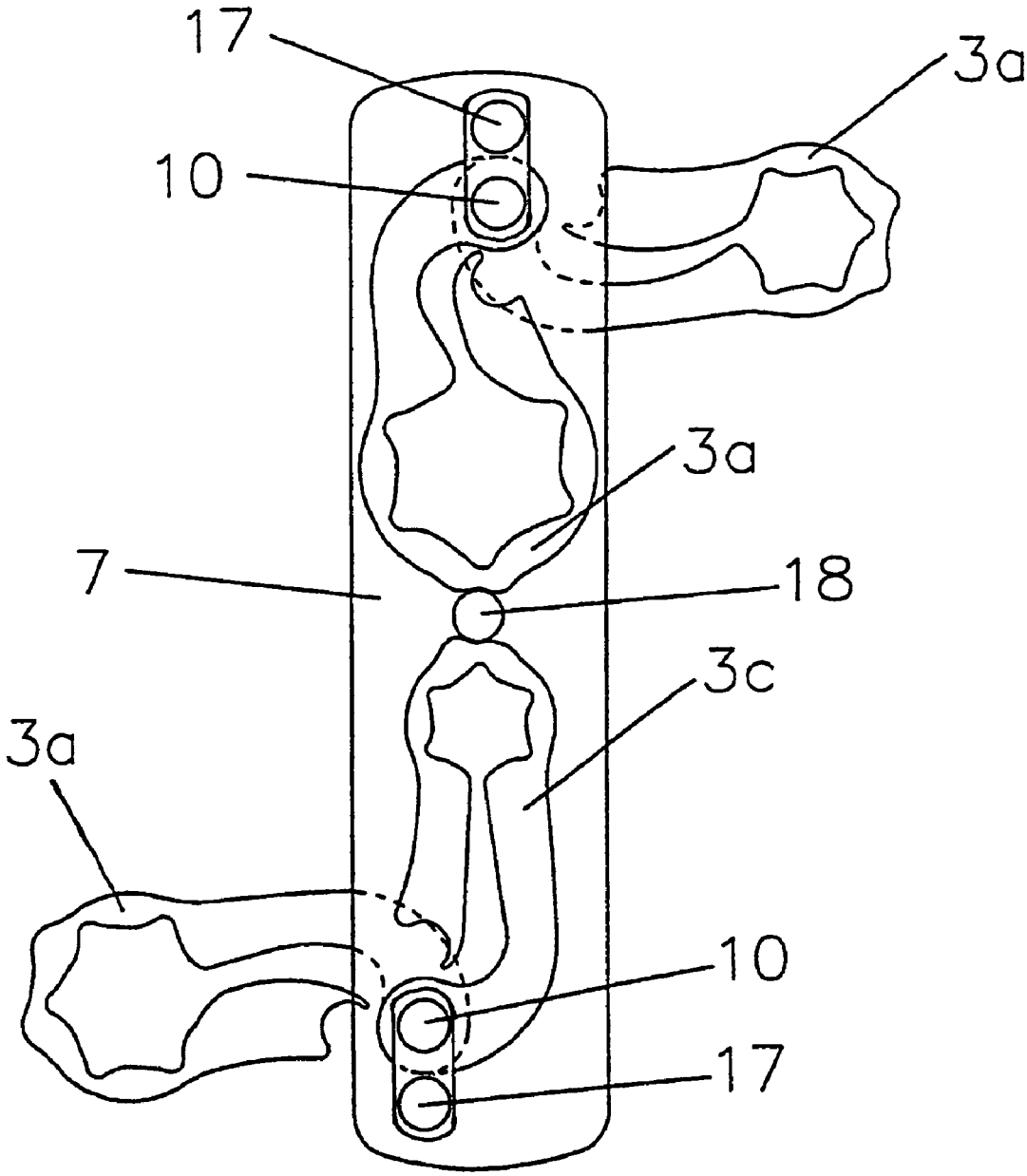

The embodiment in FIG. 11(*b*) is similar to the embodiment of FIG. 11(*a*) but has two wrench heads (3,4). Both wrench heads operate in the same manner as the wrench heads disclosed above.

The embodiment of FIG. 11(*c*) is again similar in operation to the embodiments of FIGS. 11(*a*) and 11(*b*). However, in this case as shown in FIG. 11(*c*) two wrench heads are located on one side of central plate 7 and two further wrench heads are located on the opposite side of plate 7 making four heads on one wrench.

As previously mentioned, a wrench with four different sizes of socket enables use of the wrench with a very wide range of sizes of fastener from say 6 to 19 mm as well as near equivalent imperial or metric sizes, and near Whitworth, B.S.P and A/F sizes.

There has thus been disclosed various embodiments of a wrench in accordance with the present invention. These wrenches have the particular additional advantage that in extreme conditions the resilience of the metal of the wrench head is such that the tongue (3*d*) and the bridge (3*c*) will contact each other closing the gap (3*g*) therebetween. Such contact serves to protect the fastener from any additional forces being applied to it. Moreover, because in use the flexible ring is being pulled around a fastener, the wrench head is considerably stronger than known wrenches.

Preferably, the thickness of the resilient wrench head varies in a lateral direction across the flexible ring (3*a*), that is in a direction from tongue (3*d*) to bridge (3*c*), with the tongue being thinner than the bridge because the tension in the wrench head in use is greater in the bridge than in the flexible tongue.

The invention claimed is:

1. A fold-away wrench including a handle and a wrench head mounted on the handle for pivotal movement relative thereto, the wrench head comprising an open flexible ring socket for engaging a fastener to be moved and means being provided on the wrench for closing said open flexible ring socket about a fastener when the handle is turned in a predetermined direction, the wrench head being pivotable from a storage position within the handle to an operative position extending outwardly of the handle.

2. A wrench as claimed in claim 1, wherein the open flexible ring socket is pivotally mounted on an axis pin on the handle at one end of the socket ring and said closing means comprises a fulcrum pin engageable with the opposite end of the flexible ring socket for closing the socket over a fastener.

3. A wrench as claimed in claim 2, wherein the axis pin and the fulcrum pin are aligned along a line parallel to the longitudinal axis of the handle.

4. A wrench as claimed in claim 3, wherein the fulcrum pin is the outermost pin relative to the centre of the handle.

5. A wrench as claimed in claim 2, wherein the fulcrum pin and axis in are movable longitudinally of the handle.

6. A wrench as claimed in claim 5, comprising a slot in the handle along which the fulcrum and axis pins are slidable.

7. A wrench as claimed in claim 6, wherein the slot is of a constant width along its length.

8. A wrench as claimed in claim 6, wherein the slot comprises regions of increased width along its length.

9. A wrench as claimed in claim 8, wherein the slot comprises a bulbous inner end relative to the length of the handle, of a diameter greater than the width of the slot.

10. A wrench as claimed in claim 8, wherein the slot comprises two opposed concave recesses alignable with the axis pin when the fulcrum pin engages the outermost end of the slot remote from the bulbous end.

11. A wrench as claimed in claim 8, wherein the axis in and fulcrum pin are each cylindrical and include regions of diametrically opposed planar surfaces.

12. A wrench as claimed in claim 11, wherein the cylindrical surfaces of the axis pin corresponds to the diameter of the bulbous end of the slot and opposed recesses so that the axis pin can rotate therein.

13. A wrench as claimed in claim 11, wherein the diametrically opposed parallel planar surface of the axis pin are spaced by an amount corresponding to the width of planar side walls of the slot so that the axis pin slidable in the slot with the planar surfaces of the pin aligned parallel to the planar side walls of the slot.

14. A wrench as claimed in claim 11, wherein the opposed parallel planar surfaces of the axis pin extend the whole length of the axis pin.

15. A wrench as claimed in claim 11, wherein the opposed parallel planar surfaces of the fulcrum pin extend over a portion of the length of the fulcrum pin from each end thereof, an intermediate space between the two said planar surface portions comprising a cylindrical formation.

16. A wrench as claimed in claim 1, wherein the wrench head comprises two interconnected open flexible ring sockets together pivotable about the same axis pin.

17. A wrench as claimed in claim 16, comprising two interconnected ring socket sets, one located at each end, respectively, of the handle for movement relative thereto.

18. A wrench as claimed in claim 16, wherein the interconnected flexible ring sockets comprise sockets of different sizes.

19. A wrench as claimed in claim 2, wherein each open flexible ring socket comprises an arm extending outwardly from an open end thereof for connection to the axis pin, and a freely movable arm extending from the other open end of the flexible ring and being engage able with the fulcrum pin for movement towards the first mentioned arm to close the socket around a fastener to be moved.

20. A wrench as claimed in claim 1, wherein the wrench head comprises a single open flexible ring socket mounted on a pivot for pivotal movement relative to the handle.

21. A wrench as claimed in claim 20, comprising a pair of single open flexible ring sockets, one socket located at each end, respectively, of the handle for pivotal movement relative to the handle.

22. A wrench as claimed in claim 21, comprising a pair of single open flexible ring sockets mounted on either side of a central plate, one socket of each pair of sockets being located at each end, respectively, of the handle.

* * * * *